US005830323A

United States Patent [19]

Grimm

[11] Patent Number: 5,830,323

[45] Date of Patent: Nov. 3, 1998

[54] APPARATUS FOR DEWATERING A FIBER WEB

[75] Inventor: Helmut Grimm, Ellwangen, Germany

[73] Assignee: Voith Sulzer Papiermaschinen GmbH, Heidenheim, Germany

[21] Appl. No.: 658,407

[22] Filed: Jun. 5, 1996

[30] Foreign Application Priority Data

Jun. 21, 1995 [DE] Germany ..... 185 22 462.0

[51] Int. Cl.[6] ..... D21F 3/04

[52] U.S. Cl. ..... 162/360.2; 162/358.3; 162/359.1

[58] Field of Search ..... 162/358.3, 359.1, 162/360.2, 360.3, 306

[56] References Cited

U.S. PATENT DOCUMENTS

| | | | |
|---|---|---|---|
| 5,308,450 | 5/1994 | Braun et al. | 162/358.3 |
| 5,368,697 | 11/1994 | Steiner et al. | 162/360.2 |
| 5,501,775 | 3/1996 | Kotitschke et al. | 162/360.3 |

FOREIGN PATENT DOCUMENTS

| | | | |
|---|---|---|---|
| 9206340 | 12/1992 | Germany . | |
| 4419400 | 4/1995 | Germany . | |
| 16821 | 6/1995 | WIPO | 162/358.3 |
| 9516821 | 6/1995 | WIPO . | |

*Primary Examiner*—Karen M. Hastings
*Attorney, Agent, or Firm*—Ostrolenk, Faber, Gerb & Soffen LLP

[57] ABSTRACT

Apparatus for dewatering a fiber web between the wire section and the drying section of the paper machine and for supporting the web between those sections. A first and a second spaced apart long-nip press with a transfer belt conducting the web between the presses. A first dewatering belt carries the web through the first press. A second dewatering belt carries the web through the second press. Both the first dewatering belt and the transfer belt contact one of the top and bottom sides of the web. Both the second dewatering belt and an additional transfer belt for transferring the web to the following drying section from the second press contact the other of the top and bottom sides of the web. The first and second long-nip presses are inverted with reference to each other. There may be an additional transfer belt from the wire section or into the drying section.

7 Claims, 2 Drawing Sheets

APPARATUS FOR DEWATERING A FIBER WEB

BACKGROUND OF THE INVENTION

The present invention relates to a device for dewatering a fiber web, preferably a web of paper or board, through successive long nip presses which act respectively on the opposite sides of the web to be dewatered and relates to the transfers of the web through and beyond the presses. The invention preferably concerns the press section of a paper manufacturing machine. Examples of such two successive long nip press, press sections are found in German Gebrauchsmuster G 92 06 340.3. The invention is an improvement upon the dewatering press section disclosed in German patent application P 44 19 400.5, incorporated herein.

SUMMARY OF THE INVENTION

The present invention relates to further developments of the object of the above mentioned German patent application P 44 19 400.5. It is not necessary that the shortest possible web path be present between the two long nip presses, even if such a short distance is desired to obtain a compact construction.

Rather, it is essential that, in all conceivable configurations, the web be conducted on a path which is as completely closed as possible, i.e., the web is supported not only, as heretofore, from the preceding wire section to the first long-nip press, and from the first to the second long nip press, but also from the second long nip press to the following treatment station, which usually is a drying section.

The invention concerns an apparatus for dewatering a fiber web between the wire section and the drying section of the paper machine and for supporting the web between those sections. There are a first and a second spaced apart long-nip press and a transfer belt conducts the web between the presses. A first dewatering belt carries the web through the first press. A second dewatering belt carries the web through the second press. Both the first dewatering belt and the transfer belt contact one of the top and bottom sides of the web. Both the second dewatering belt and an additional transfer belt, which transfers the web to the following drying section from the second press, contact the other of the top and bottom sides of the web. To accomplish the foregoing, the first and second long-nip presses are preferably inverted with reference to each other (one above the backing roll, the other below that roll). There may be an additional transfer belt from the wire section or into the drying section.

The following results are to be obtained:

a) When the top side of the web comes into contact with the first dewatering felt in the first long nip press and when the bottom side of the web thereafter comes into contact with the second dewatering felt in the second long nip press, an additional transfer belt contacts the bottom of the web to transport it toward the following drying section.

b) Before the web enters the drying section, there is a closed transfer of the web from the additional transfer belt to a dryer wire which contacts the top side of the web, so that the bottom side of the web comes into direct contact with at least the first cylinder of the drying section. This differs from FIG. 6 of Federal Republic of Germany Utility Model 92 06 340.3.

c) When the first dewatering belt contacts the bottom side of the web in the first long nip press and when the top side of the web thereafter comes into contact with the second dewatering belt in the second long nip press, this enables a dryer wire to transfer the web in closed fashion from the second long nip press into the following drying section.

d) An additional transfer belt is then provided between the preceding wire section and the first long nip press and the additional belt comes into contact, like a pick-up felt, with the top side of the web and transfers the web to the first dewatering belt before the first long nip press.

Both of the above described embodiments of the invention, a), b) and c), d), are particularly suitable for modern, high speed paper manufacturing machines having operating speed web travel in the order of magnitude of between 1000 and 2000 meters per minute. Due to the guidance of the dewatering and transfer belts described, rewetting of the web of paper following each of the two long nip presses is avoided, so that the web of paper has a relatively high content of dry matter upon its passage into the following drying section. This permits a considerable saving in energy in the following drying section.

Because both presses are developed as long nip presses, and preferably as shoe presses, this contributes to that high content of dry matter of the press dried web. In this way, the dewatering of the paper web is effected in a very gentle manner.

The described guidance of the dewatering belts causes the two sides of the web to alternately come into contact one after the other with a smooth unfelted press roll in the two long nip presses. As is already known, this avoids so-called two sidedness of the finished paper web. Two sidedness is caused in many traditional paper manufacturing machines by the web not being uniformly dewatered on both sides.

Removing the web of paper from a smooth press roll by a transfer belt permits the web of paper to be tensioned slightly in the direction of web travel because the transfer belt is driven at a slightly higher speed than the press roll. This provides more stable travel of the web possibly also in the following drying section.

Other features and advantages of the present invention will become apparent from the following description of the invention which refers to the accompanying drawings.

BRIEF DESCRIPTION OF THE DRAWINGS

Two embodiments of the invention are described below in FIGS. 1 and 2, which each show a press section of the invention in a diagrammatic side view.

DESCRIPTION OF PREFERRED EMBODIMENTS OF THE INVENTION

Figure 1:
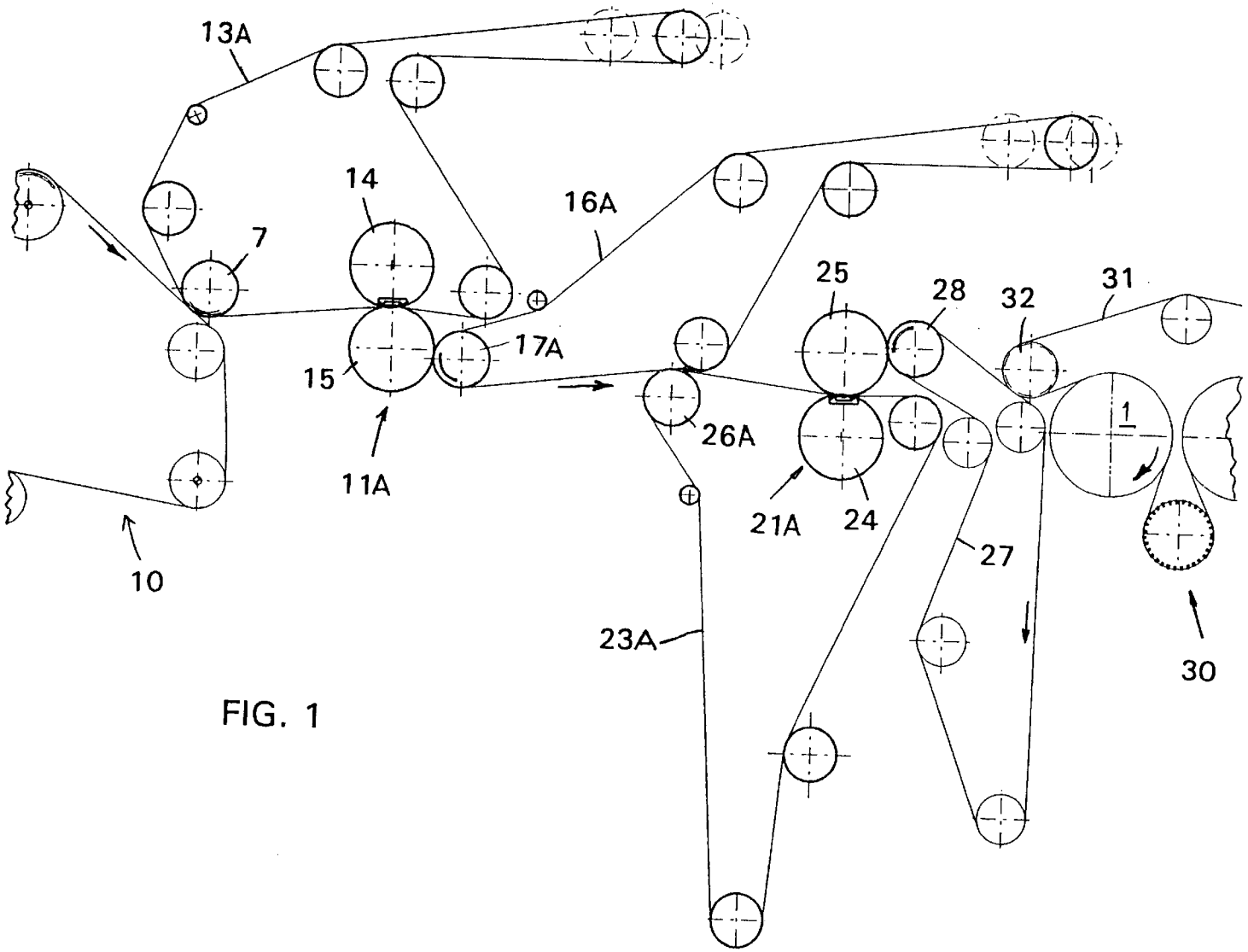

FIG. 1 schematically shows parts of a paper making machine wire section 10, a first long nip press 11A, a second long nip press 21A, and parts of a drying section 30. A first (top) dewatering belt 13A for instance, a press section wet felt, in this case a pick-up felt, takes over the paper web to be dewatered from the dewatering wire of the wire section 10 due to the action of a pick-up roll 7. The belt 13A conducts the web through the first long nip press 11A. That press includes a top shoe press roll 14 and a normal smooth bottom press roll or counter roll 15 whose constructions are well known.

The bottom side of the web comes into direct contact with the smooth roll 15. The top side of the web is dewatered by the belt 13A passing through the first nip.

Following the first nip, a transfer belt 16A takes the web over from the press roll 15 by means of a pick-up roll 17A.

From the transfer belt 16A, the web is taken over by a second bottom dewatering belt 23A which passes over a take up roll 26A, and the web is then conducted through the second long nip press. The second press includes a bottom shoe press roll 24 and a top smooth press roll or counter roll 25, the inverse of the first press.

The web is then removed from the smooth press roll 25, to which the web had adhered, by an additional transfer belt 27 and a take-up roll 28. The web is transported by the belt 27 to the first dryer wire 31 of a drying section 30. The web is taken onto the dryer wire 31 by a take-up roll 32 and is brought by the wire 31 into contact with a first drying cylinder 1, and then with further drying cylinders as in known drying sections.

Throughout the entire travel through the press section and past two long nip presses, the web is always supported.

The embodiment shown in FIG. 2 differs from that shown in FIG. 1 in the following points:

The two long nip presses 11B, 21B are turned 180° or are inverted from the orientations of those presses in FIG. 1. In the first long nip press 11B, the shoe press roll 14 is contained in the loop of the dewatering belt 13B and is in the lower position, while the smooth press roll 15 is in the upper position. Therefore, an additional belt 6 is provided, which acts as a pick-up felt by means of the pick-up roll 7 to transfer the web from the wire section to the first dewatering belt 13B. A further consequence of inverting the presses is that the transfer belt 16B does not contact the top of the paper web but instead contacts the bottom. Furthermore, the second dewatering belt 23B contacts the top side of the web. Since the smooth press roll 25 in the second press 21B is in the bottom position, the dryer wire 31 can take the web over by means of the take-up roll 32 directly from the press roll 25 and then conduct the web over the first drying cylinders 1, 2, etc.

Figure 2:
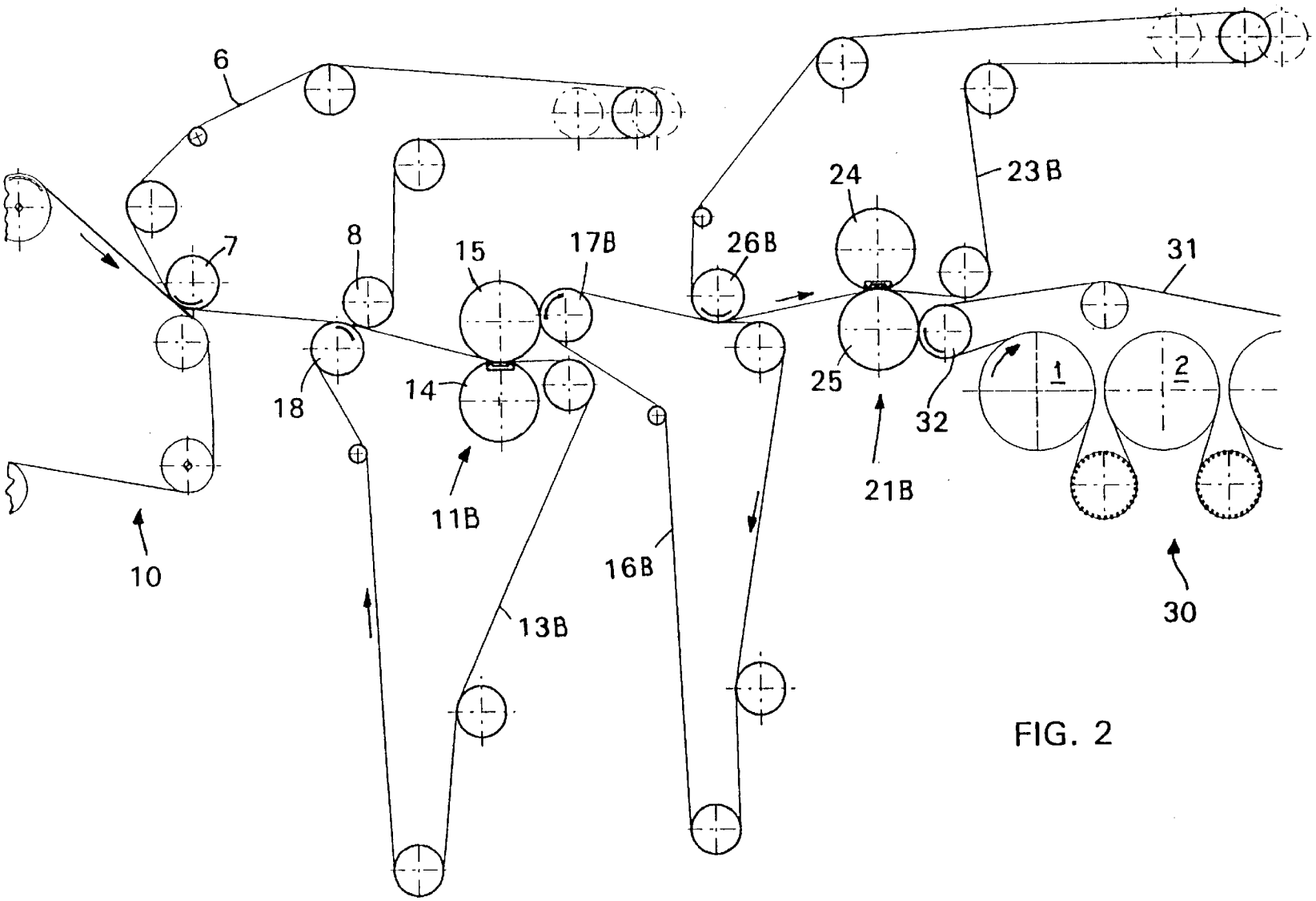

An additional advantage of the construction shown in FIG. 2 is described. At the place where the first dewatering belt 13B takes the web over from the pick-up felt 6 by means of a take-up roll 18, and therefore before the first press nip and shortly in front of a guide roll 8, any wire marking in the paper web which is caused in the wire section 10 is covered by a felt marking as a result of the cooperation of the two felts 6 and 13B. In other words, undesired wire marking is substantially eliminated before the dewatering in the press section.

In a variant not shown in the drawing, two press rolls can be provided instead of the guide roll 8 and the take-up roll 18, wherein the press rolls form a double felt press with each other at this place.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. Apparatus for dewatering a fiber web coming from a wire section and moving through the apparatus to a following drying section, the apparatus comprising:

a first and a second long-nip press in series along the path of the web through the apparatus;

a first dewatering belt for receiving the web from the wire section and for passing the web through the first long-nip press, and for supporting the web so that only the bottom side of the web contacts the first dewatering belt;

a transfer belt for engaging the web after passing the first press and while the web is still supported at the first press and for transferring the web toward the second press, the first dewatering belt and the transfer belt contacting the bottom side of the web;

a second dewatering belt for directly receiving the web from the transfer belt and for supporting the web so that only the top side of the web contacts the second belt, the second belt receiving the web so that there is no open pathway of the web between the transfer belt and the second dewatering belt and for passing the web through the second press; and means transferring the web directly from the second press to the drying section, without a transfer belt therebetween or an open pathway of the web, the second dewatering belt and the means transferring the web from the second press to the following drying section contacting the top side of the web.

2. The apparatus of claim 1, further comprising a first transfer belt for transferring the web from the preceding wire section to the first dewatering belt without an open pathway of the web.

3. The apparatus of claim 1, wherein the first press includes a first long nip press roll and a counter-roll between which rolls the web is passed, the first long-nip press roll is below the counter-roll of the first press; the second press includes a second long nip press roll and a counter-roll between which rolls the web is passed, the second long-nip press roll is above the counter-roll of the second press; and the press roll of the second press comprises the means transferring the web to the drying section.

4. The apparatus of claim 1, wherein the second press contacts the means transferring the web from the second press to the drying section.

5. The apparatus of claim 4, wherein said means for transferring the web includes a second transfer belt comprising a first dryer wire for transferring the web into the drying section.

6. The apparatus of claim 1, further comprising a pick-up belt which contacts the top side of the web to conduct the web from a section of the machine preceding the first nip to the first dewatering belt such that the web is supported to the first dewatering belt.

7. The apparatus of claim 6 further comprising a guide roll for directing said pick-up belt and a take-up roll for directing said first dewatering belt; said take-up roll and said guide roll being arranged with respect to each other such that both of said pick-up belt and said first dewatering belt concurrently contact the web along a specified path between said guide roll and said take-up roll.

* * * * *